United States Patent [19]

Hirashima et al.

[11] 3,944,764

[45] Mar. 16, 1976

[54] INERTIA SENSOR SWITCH

[75] Inventors: Kenzo Hirashima; Yasuhiko Fujiwara, both of Yokohama, Japan

[73] Assignee: Nissan Motor Company Limited, Yokohama, Japan

[22] Filed: Aug. 8, 1974

[21] Appl. No.: 496,020

[30] Foreign Application Priority Data

Aug. 17, 1973 Japan ..... 48-96139[U]

[52] U.S. Cl.... 200/61.45 M; 200/61.48; 200/61.49; 200/61.51

[51] Int. Cl.[2] ..... H01H 35/14

[58] Field of Search 200/DIG. 45, 61.45 R, 61.45 M, 200/61.48, 61.53, 61.44

[56] References Cited

UNITED STATES PATENTS

| | | | |
|---|---|---|---|
| 2,313,549 | 3/1943 | Hornain | 200/61.48 |
| 2,972,026 | 2/1961 | Kendall | 200/61.5 |
| 3,749,863 | 7/1973 | Kaiser | 200/61.45 R |
| 3,832,507 | 8/1974 | Marquardt et al. | 200/61.48 X |
| 3,840,088 | 10/1974 | Marumo et al. | 200/61.45 M X |
| R28,251 | 11/1974 | Bell | 200/61.53 |

*Primary Examiner*—Robert K. Schaefer

[57] ABSTRACT

An inertia sensor switch comprises an insulating housing having an electrical contact plate connectable to one electric terminal, an electrical contact mass abuttingly engageable with the electrical contact plate and resilient means for holding the electrical contact mass to a position spaced from the electrical contact plate, in which the resilient means is a U-configured resilient strip of an electrical conductive material having one leg fixed to the electrical contact mass and other leg secured to the interior of the insulating housing, the other leg being connectable to another electric terminal cooperating with the one electric terminal, the U-configured resilient strip lying in a plane normal to deceleration due to up and down vibration of the vehicle, the U of the U-configured resilient strip being open to a transverse direction relative to a longitudinal direction of the vehicle.

6 Claims, 12 Drawing Figures

INERTIA SENSOR SWITCH

The present invention relates to an inertia sensor switch for a vehicle.

The inertia sensor switch is particularly useful in an electric actuating circuit, which may be connected to such safety devices as an air bag, a device to withdraw a steering column, or a device to tighten a seat belt.

When a vehicle equipped with an air bag is involved in a collision, the air bag is effective in protecting an occupant only if the collision is within a 60° range of azimuth or directional angle, i.e., 30° on either side of the forward direction of the vehicle. Inflation of the air bag in a collision outside this range would not efficiently protect the occupants. The noise of inflation might even startle the driver or more seriously impair the driver's ability to control the vehicle. Therefore, a inertia sensor switch for effecting inflation must be able to discriminate between deceleration due to a collision within the said 60° range and deceleration due to a collision outside of the said 60° range. Moreover it is desirable that an inertia sensor switch operates in the same manner in collisions of equal severity but having different directions of impact within the selected azimuth angle range.

When an automotive vehicle is driven along a rough road or hits a hole in a road, the vehicle vibrates up and down. An inertia sensor switch thus, must not operate under such conditions.

It is an object of the present invention to provide an inertia sensor switch simple in construction but meeting the above requirements.

The present invention will now be described in more detail, with reference to the accompanying drawings, in which.

Figure 1:
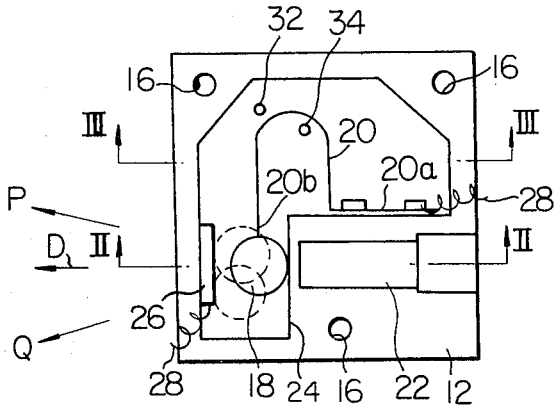
FIG. 1 is a schematic plan view of an inertia sensor switch embodying the invention.
Figure 4A:
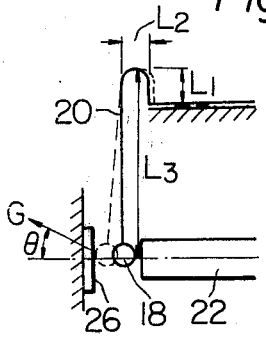
Figure 4B:
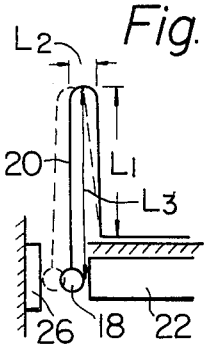
Figure 4C:
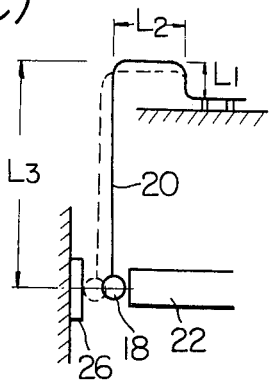
Figure 5:
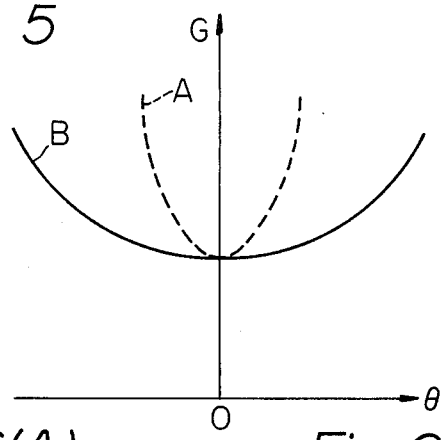
Figure 6A:
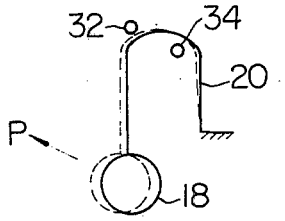
Figure 6B:
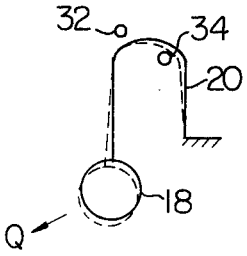
Figure 7:
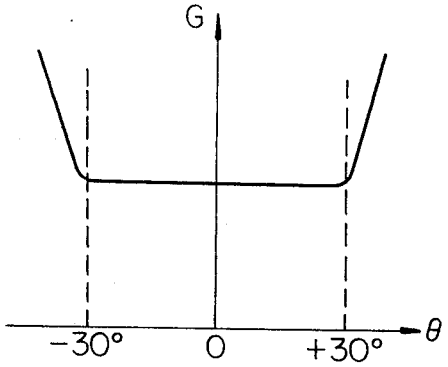
Figure 8:
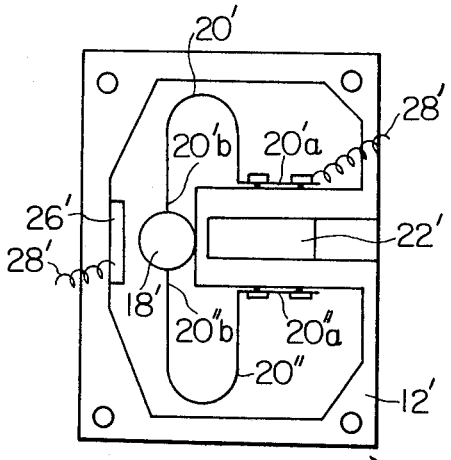
Figure 9:
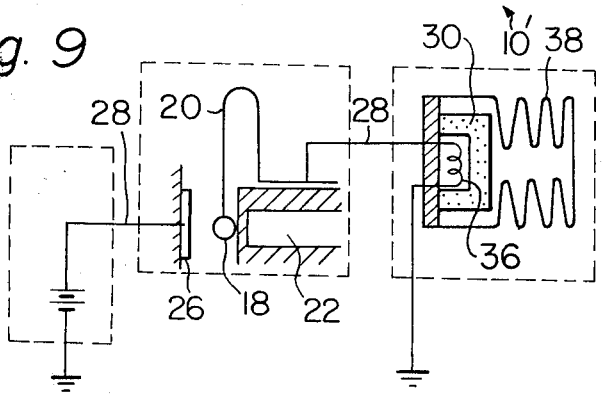

FIGS. 4(A), 4(B) and 4(C) are diagrams showing different dimensions of a U-configured resilient strip;

FIG. 5 is a graph in which curve A (dotted lines) shows the relation between a deceleration force G applied to a housing of FIG. 4(A) by which a mass is moved to an actuated position (shown in dotted lines in FIG. 4(A)) and an azimuth angle $\theta$ along which the deceleration force is applied; and curve B (solid line) shows such relation in connection with FIG. 4(B);

FIGS. 6(A) and 6(B) are diagrams showing a U-configured resilient strip and stops of FIG. 1 when the mass is moved in the same direction but to opposite sides of the forward direction of the vehicle;

FIG. 7 is a similar graph of FIG. 5 showing a preferred operation characteristic of the collision sensor;

FIG. 8 is a similar view to FIG. 1 illustrating another embodiment of the invention, in which to retain a mass against mulfunction due to vibration of a housing when a vehicle vibrates up and down to U-configured resilient strips are disposed on opposite sides of the mass; and FIG. 9 is a schematic illustration showing a safety apparatus employing a collision sensor of the invention.

Figure 2:
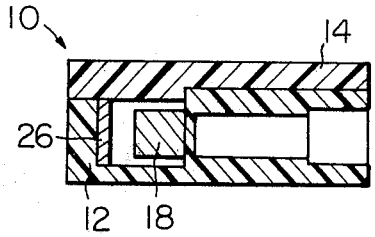
FIG. 2 is a cross sectional view taken along lines II—II of FIG. 1.

Referring to FIGS. 1 and 2, a housing 10 made of insulating material includes a casing portion 12 and a lid portion 14 which is secured to the casing portion 12 by a plurality of screws (not shown), only three threaded holes 16 formed in the casing portion 12 being shown. The casing portion 12 should preferably be made of a synthetic resin having considerable mechanical strength, such as epoxy resin, polycarbonate, and polyester resin, or F R P of nonmagnetic material made of other resin reinforced with glass wool. The lid portion 14 can be made of the same material or organic glass possessing high transparency and mechanical strength, such as methacrylate resin.

The housing 10 is secured to a part of a vehicle (not shown) which is subjected to deceleration. Disposed in housing is an electrically conductive disc configured mass 18 which is movable against the influence of a resilient strip 20 which is a U-configuration curved from a plate spring strip from an initial position or condition, shown in solid lines, to an actuated position or condition, shown in dotted lines, under the influence of collision forces. Preferably, a magnet 22 should be provided to attract mass 18 to the initial position. In the initial position, the mass 18 is held against a wall 24 by the magnet 22 and the U-configured resilient strip 20. In the actuated position (shown in dotted lines in FIG. 1), the mass 18 is forced to abut on a fixed electrical contact plate 26 which is associated with one of two wires 28, the other one of the wires 28 being associated with U-configured resilient strip 20. This abutting of the mass 18 on the fixed electrical contact 26 ensures completion of an electrical circuit to activate an explosive charge 30 (see FIG. 9).

The U-configured resilient strip 20 has one leg 20*a* secured to the housing 10 and other leg 20*b* fixed to the mass 18 to hold the mass to the initial position. It is to be noted that the strip 20 should lie in a plane normal to deceleration due to up and down vibration of the vehicle and the U of the U-configuration of the strip open to transverse direction relative to the forward direction of the vehicle. With this configuration of the strip 20 the mass 18 is responsive only to a deceleration within a selected range of azimuth or directional angle respect to forward direction of a vehicle, indicated by an arrow D (see FIG. 1), but movement of the 18 mass due to up and down vibration of the housing 10 is prevented.

Referring to FIG. 5 together with FIGS. 4(A) through 4(C), curve A, shown in dotted lines, represents operation characteristic of a sensor apparatus utilizing U-configured resilient strip having length components of $L_1$, $L_2$ and $L_3$ and curve B, shown in solid lines, operation characteristic of an inertia sensor switch utilizing a U-configured resilient strip which has a larger $L_1$ length component than that of the U-configured resilient strip shown in FIG. 4(A). From this it will be understood that increasing the $L_1$ length component results in a flatening of the characteristic curve shown in FIG. 5. It will also be understood that changing any of the length components $L_1$, $L_2$ or $L_3$ (see FIG. 4(C)) results in the change of operation characteristic of a safety apparatus. Therefore, selecting appropriate dimensions, material, width and thickness of a U-configured resilient strip is necessary to construct an inertia sensor switch which has a preferable operation characteristic similar to curve C illustrated in a graph of FIG. 7.

Figure 3:
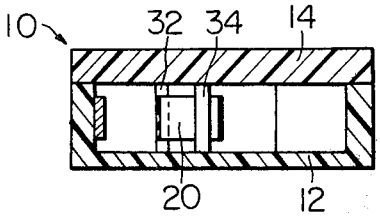
FIG. 3 is a cross sectional view taken along lines III—III of FIG. 1.

To obtain suitable operation characteristics analogous to the preferable operation characteristic shown in the curve in FIG. 7, it is preferable, as shown in FIGS. 1 and 3, to mount stops 32, 34 in the housing 10 to limit movement of the mass 18 as readily understood from FIGS. 6(A) and 6(B). In FIG. 6(A) the mass is shown located in position indicated in dotted lines when a deceleration force is applied to the housing from a directioon as indicated by arrow P, whereas, when a deceleration force is applied from a direction as indicated by arrow Q, the mass 10 is to a position as indicated by dotted lines of FIG. 6(B). When a deceleration force in the direction of P is applied, displacement of the U-configured resilient strip is limited by abutting engagement of the strip 20 with the stop 32, while, on the other hand, when a deceleration force in the direction of arrow Q applied displacement is limited by abutting engagement thereof with the stop 34. However, it will be appreciated that when a deceleration is applied within a range of azimuth angle between the arrows P and Q the strip 20 will not engage any of the stops 32 and 34 upon movement of the mass 18 to the fixed electrical contact plate 26.

Although in this embodiment shown in FIGS. 1 to 3 only two pole-shaped stops are provided, the number, shape and location of such stops are not limited to this embodiment, as far as displacement of a U-configured resilient strip is limited so that an inertia sensor switch will have a preferable operation characteristic.

The embodiment illustrated in FIG. 8 is different from the preceding embodiment in that two U-configured resilient strips 20' and 20'' support a disc or mass 18' to hold it to an initial position. The corresponding parts in FIG. 8 are now designated by the same reference numerals, respectively but added by primes.

The U-configured resilient strips 20' and 20'' have respective legs 20'*a* and 20''*a* fixed to a housing 10' and respective other legs 20'*b* and 20''*b* fixed to the mass 18', and they are disposed on the opposite sides of the mass 18' and in the common plane. With this construction mulfunction of a collision sensor due to vibration of the vehicle 10' can be more effectively minimized.

FIG. 9 illustrates a safety apparatus, as an example, utilizing a collision sensor of the invention, in which 36 designates trigger device for explosive charge 30, and 38 an air bag cushion. In operation, when the mass 18 moves to an actuated position upon collision of a vehicle, air bag is inflated to protect an occupant of the vehicle (not shown).

From the preceding description, it will be appreciated that an inertia sensor switch of the invention operates within a selected range of azimuth or directional angle without mulfunction due to up and down vibration of its housing. Moreover it will be appreciated that an inertia sensor switch of the invention is simple in construction and reliable in operation without periodic maintenance service. Thus minimization of a sensor apparatus is possible. Therefore, an inertia sensor switch of the invention is particularly useful in association with vehicle equipped with a safety apparatus.

What is claimed is:

1. In a vehicle having a longitudinal direction,
an inertia sensor switch comprising:
a housing of an insulating material fixedly secured to the vehicle;
a fixed electrical contact plate mounted securely to the interior of the housing, the fixed electrical contact being connected to one of two electric wires;
an electrically conductive mass selectively abuttingly engageable with the fixed electrical contact plate; and
a U-configured resilient strip having one leg secured to a portion of the housing and other leg fixed to the mass, the U-configured resilient strip being made of an electrical conductive material and serving as an electrical path between the mass and other one of the two electric wires, the U-configured resilient strip resiliently biasing the mass to an initial inoperative position that is spaced from the fixed electrical contact plate rearwardly in the longitudinal direction with respect to the vehicle;
in which the U-configured resilient strip lies in a plane normal to deceleration due to up and down vibration of the vehicle, the U of the U-configured resilient strip being open to a transverse direction relative to the longitudinal direction.

2. An inertia sensor switch as claimed in claim 1, including two of such resilient strips, in which said strips are disposed on the opposite sides of said mass and lie in the plane normal to deceleration due to up and down vibration of the vehicle.

3. An inertia sensor switch as claimed in claim 1, in which two stops are mounted in said housing, said stops being disposed on opposite sides of said other leg of said resilient strips, said stops being spaced apart and not contacting said other leg when said mass in in said initial inoperative position, said stops being so constructed and arranged as to limit, by contact therewith, movement of said other leg which is fixed to said mass due to movement of said mass in directions outside of a predetermined range of directional angle on neither side of the longitudinal direction of the vehicle.

4. An inertia sensor switch as claimed in claim 1, in which a magnet is so mounted in said housing as to attract said mass to the initial inoperative position thereof.

5. An inertia sensor switch as claimed in claim 2, in which a magnet is so mounted in said housing as to attract said mass to the initial inoperative position thereof.

6. An inertia sensor switch as claimed in claim 3, in which a magnet is so mounted in said housing as to attract said mass to the initial inoperative position thereof.

* * * * *